US006192854B1

(12) United States Patent
Polach

(10) Patent No.: US 6,192,854 B1
(45) Date of Patent: Feb. 27, 2001

(54) DEVICE FOR MEASURING THE MASS OF A FLOWING MEDIUM

(75) Inventor: Wilhelm Polach, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/465,842

(22) Filed: Dec. 17, 1999

(30) Foreign Application Priority Data

Dec. 28, 1998 (DE) ..... 198 60 468

(51) Int. Cl.[7] ..... F02M 7/00

(52) U.S. Cl. ..... 123/198 D; 123/198 DB; 123/435

(58) Field of Search ..... 123/458, 198 D, 123/198 DB, 198 F, 436, 435

(56) References Cited

U.S. PATENT DOCUMENTS 4,539,959 * 9/1985 Williams ..... 123/456
5,190,013 * 3/1993 Dozier ..... 123/435
5,433,182 * 7/1995 Augustin ..... 123/198 F
5,577,479 * 11/1996 Popp ..... 123/456
5,816,220 * 10/1998 Stumpp et al. ..... 123/198 D
5,868,111 * 2/1999 Augustin ..... 123/198 D

* cited by examiner

*Primary Examiner*—Thomas N. Moulis
(74) *Attorney, Agent, or Firm*—Ronald E. Griegg; Edwin E. Greigg

(57) ABSTRACT

A fuel injection system for multi-cylinder internal combustion engines, which has one injection unit per cylinder. Each injection unit includes one injection valve, one control valve, one flow limiting valve and one injection nozzle and is supplied with fuel via a fuel delivery line. Each injection unit also has a control unit which actuates the applicable control valve. This actuated control valve then actuates the associated injection valve, which in turn opens the fuel delivery line upstream of the injection nozzle. The flow limiting valve disposed upstream of the injection valve in the fuel delivery line blocks fuel flow when the fuel quantity flowing through the flow limiting valve attains a maximum fuel quantity, and the flow limiting valve does not open again until the fuel delivery line is blocked downstream of the flow limiting valve. To improve this system, each injection unit is assigned a sensor, with which a leak downstream of the flow limiting valve can be indicated; the control unit increases the injection duration, for the cylinder affected by a leak, enough though the correlated fuel quantity is greater than the maximum fuel quantity.

20 Claims, 2 Drawing Sheets

DEVICE FOR MEASURING THE MASS OF A FLOWING MEDIUM

FIELD OF THE INVENTION

The invention is based on a fuel injection system for a multi-cylinder internal combustion engine.

In one such fuel injection system, known for instance from German Patent Disclosure DE 44 14 242 A1, each cylinder of the engine is assigned an injection unit, and each injection unit has one injection valve, one control valve, one flow limiting valve, and one injection nozzle. A fuel pump supplies these injection units with fuel via a fuel delivery line. The fuel injection system also has a control unit, which for injecting a predetermined fuel quantity into a combustion chamber of one of the cylinders of the engine electrically actuates the appropriate control valve for an injection duration that is correlated with the predetermined fuel quantity. By means of the actuated control valve, the injection valve, which is thus hydraulically coupled in the usual way, is actuated. In this way, the fuel delivery line upstream of the applicable injection nozzle is opened by the actuated injection valve, so that fuel is injected into the combustion chamber. The flow limiting valve is also disposed in the fuel delivery line upstream of the injection valve and blocks the fuel delivery line when the fuel quantity that has flowed through the flow limiting valve or is flowing out of the flow limiting valve attains a maximum fuel quantity. This maximum fuel quantity is predetermined and is the result of whatever fuel quantity is required to attain maximum engine power in all operating ranges of the engine without causing any damage to the engine, plus a tolerable leakage downstream of the flow limiting valve, for instance in the injection valve. The flow limiting valve is embodied such that once the flow limiting valve is closed, it does not open the fuel delivery line again until the fuel delivery line is blocked downstream of the flow limiting valve. This means that the flow limiting valve does not open again until the injection valve has properly closed, and no leakage is occurring in the fuel delivery line between the flow limiting valve and the injection valve. Such a flow limiting valve thus provides protection for the engine in the event of malfunctions of the injection units or leakage downstream of the flow limiting valve. For instance, the control valve and/or the injection valve might stick in an open position. The protective function of the flow limiting valve is due to the fact that the injected fuel quantity attains the aforementioned maximum fuel quantity, for instance if the injection valve cannot close because of a metal chip in the valve seat, and thus the flow limiting valve blocks the fuel delivery line. If the affected injection valve still cannot close, then the fuel delivery line remains open downstream of the flow limiting valve, so that the flow limiting valve no longer opens. Since the affected cylinder is then decoupled from the fuel delivery line, the affected cylinder cannot be damaged by a malfunction of the injection unit. The engine can still be operated in an emergency mode, however, so that without further provisions, the vehicle can for instance be driven to a repair facility.

In a corresponding way, a leak at the injection valve can cause the flow limiting valve to block the fuel delivery line; then the leakage at the injection valve prevents re-opening of the flow limiting valve. To allow the flow limiting valve to block the fuel delivery line in the event of a leak at the injection valve, however, the leakage quantity plus the injection quantity must attain the aforementioned maximum fuel quantity. Even a relatively small leak suffices in ranges of maximum engine power. In all the other operating states of the engine, in which the fuel injection quantity is smaller, the leak must be correspondingly greater to allow the cylinder affected by the leak to be disconnected from the fuel delivery line.

OBJECT AND SUMMARY OF THE INVENTION

The fuel injection system according to the invention has an advantage over the prior art that a cylinder affected by a leak downstream of the flow limiting valve can be disconnected from the fuel delivery line even in the event of relatively small leaks, regardless of the engine operating state. The fuel injection system of the invention thus improves the operating safety of the engine.

To allow the flow limiting valve to close off the fuel delivery to the affected cylinder even in the event of relatively small leaks, in the fuel injection system of the invention, each injection unit is assigned at least one sensor, with which the fuel delivery line to the applicable cylinder can be monitored for leakage. As soon as a leak is found in the fuel delivery line downstream of the flow limiting valve, the corresponding sensor sends a signal to the control unit by means of a suitable leakage signal. The control unit then increases the injection duration for the affected cylinder, in such a way that the resultant fuel quantity injected into the combustion chamber of the affected cylinder is greater than the maximum fuel quantity. As soon as the fuel quantity flowing through the flow limiting valve attains the maximum fuel quantity, the flow limiting valve reacts as intended and blocks the fuel delivery line, so that the corresponding cylinder is decoupled from the fuel delivery line. Since a leak downstream of the flow limiting valve has been indicated by the sensor, the fuel delivery line downstream of the flow limiting valve remains open because of the existing link even if the injection valve is closed, and so the flow limiting valve can no longer open the fuel delivery line. Since the injection duration controlled by the control unit can be selected independently of the engine operating state, a cylinder shutoff is possible in all operating states, even in the presence of relatively small leaks.

If for instance the injection valve does not close completely because of contamination, a leak develops, as a result fuel flows permanently into the combustion chamber. For igniting the fuel, an overly large fuel quantity is then available after the usual injection event, so that an excess cylinder pressure arises in the affected cylinder. Moreover, such a leak in the engine can cause noticeable noise, which is typically called knocking. As sensors for monitoring leakage in the fuel delivery line, a knocking sensor and a pressure sensor are especially suitable and are then assigned to the applicable cylinder.

To reduce the risk of damage to the engine from the lengthening of the injection duration, the increase in the injection duration is limited such that the injection duration resulting from the increase is at maximum three times as great as the injection duration required to attain maximum engine power. Since the injection duration required to attain maximum engine power is dependent on the rpm of the engine at the time, a limitation in the increase of the injection duration is expediently made as a function of the engine rpm. This is done by providing that the injection duration can be increased at maximum enough that the injection can occur only as long as it takes an engine crankshaft, which is engaged by the pistons moving in the cylinders, to rotate by less than 300°; that is, the injection duration attainable by the increase is at maximum 300° of crankshaft angle. The increase in the injection duration is preferably limited to 105° of crankshaft angle.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
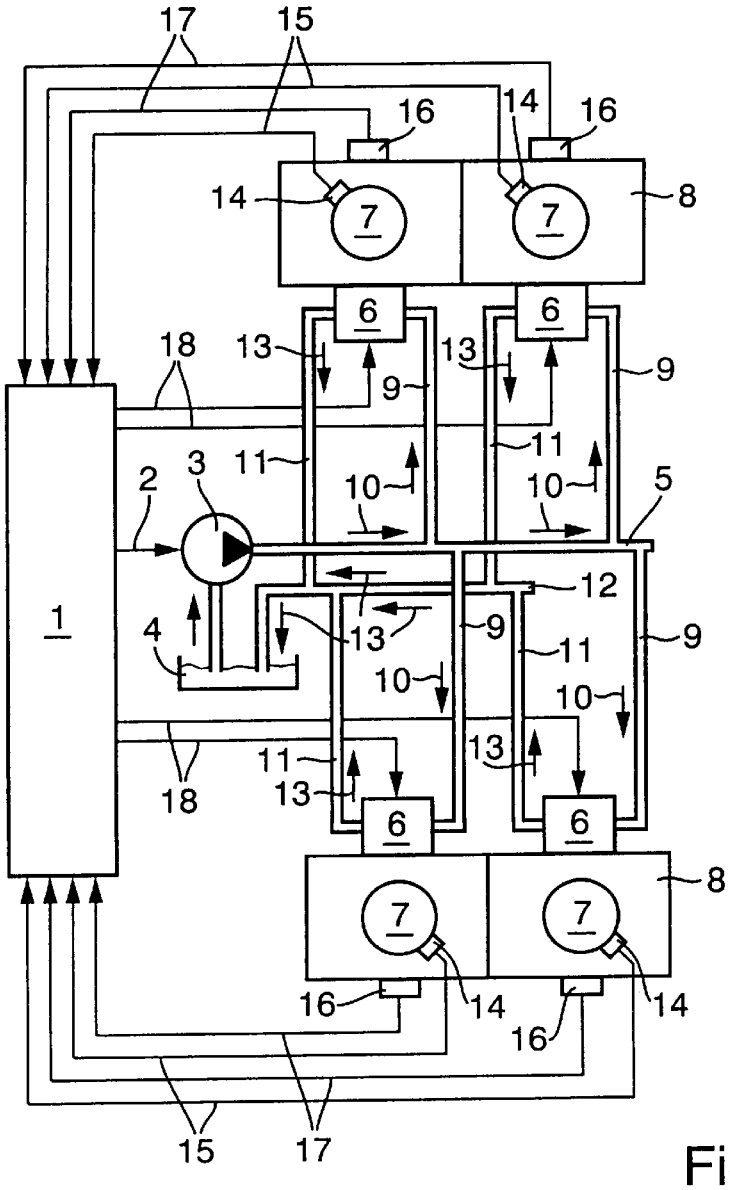
FIG. 1 is a schematic illustration of the layout of the fuel injection system for an internal combustion engine.

As seen in FIG. 1, a fuel injection system according to the invention has a control unit 1, which via a switch line 2 actuates a fuel pump 3. The fuel pump 3 is connected on the intake side to a fuel tank 4 and on the compression side to a fuel manifold 5, by way of which injection units 6 are supplied with fuel. Since all the injection units 6 are connected to one injection manifold 5, this manifold is typically called a "common rail". The injection units 6 are actuated separately by the control unit 1, via switch lines 18.

Each injection unit 6 is assigned to one cylinder 7 of an engine, of which FIG. 1 shows only two banks 8 of cylinders. It is clear that a fuel injection system of the invention is not limited to use in a V-type engine with four cylinders, but instead that engines with more or fewer cylinders, or in-line engines, can also be equipped with the fuel injection system of the invention. The injection units 6 are connected to the fuel manifold 5 via individual fuel delivery lines 9. The flow direction of the fuel is represented by arrows 10 on the high-pressure side. Since more fuel is always pumped via the fuel pump 3 than is needed for combustion in the cylinders 7, the unneeded fuel is carried via fuel return lines 11 to a lowpressure manifold 12, which returns the unneeded fuel to the fuel tank 4. The direction of flow of the fuel on the low-pressure side is indicated by arrows 13.

Each cylinder 7 is assigned a pressure sensor 14, which monitors the pressure in the associated cylinder 7 and carries a pressure signal correlated with this pressure to the control unit 1 via a corresponding signal line 15.

In addition or as an alternative, each cylinder 7 here is assigned a knocking sensor 16, which senses a noise development, known as "knocking", in the associated cylinder 7 and sends a knocking signal, correlated with the knock, to the control unit 1 over a corresponding signal line 17. An embodiment is equally possible in which one knocking sensor is used for all the cylinders 7; it can then associate defective combustion with the affected cylinder 7.

Figure 2:
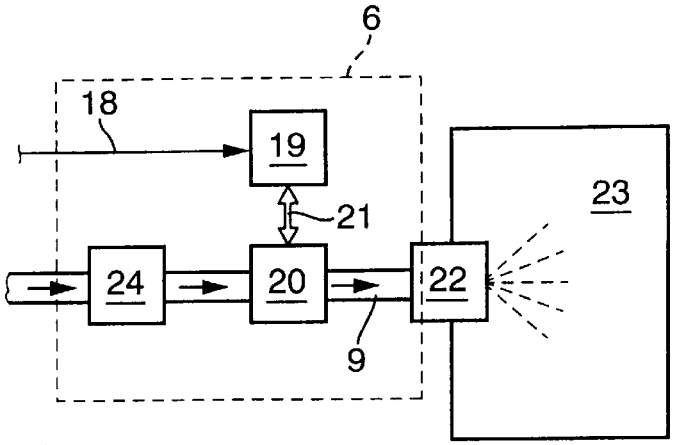
FIG. 2 is a simplified schematic illustration of an injection unit of the fuel injection system.

In FIG. 2, an injection unit 6, which is outlined by dashed lines in FIG. 2, has a control valve 19, which can be actuated, preferably electrically, by the control unit 1 via the switch line 18. The control valve 19 is coupled, in particular hydraulically, with an injection valve 20 in such a way that an actuation of the control valve 19 actuates the injection valve 20. The hydraulic coupling between the control valve 19 and the injection valve 20 is represented by a double arrow 21 in FIG. 2. The injection valve 20 is disposed in the fuel delivery line 9, which connects the injection unit 6 with the high-pressure manifold 5. The fuel delivery line 9 ends downstream of the injection valve 20 in an injection nozzle 22, which discharges into a combustion chamber 23 of the cylinder 7. Upstream of the injection nozzle 22, there is a flow limiting valve 24 in the fuel delivery line 9. For the sake of simplicity, the fuel return 11 (see FIG. 1) is not shown in FIG. 2.

The injection unit 6 of FIG. 2 functions as follows: Via the switch line 18, the control unit 1 actuates the control valve 19. The control valve 19 is thus opened, for instance, and at the injection valve 20 brings about a pressure drop, for instance, as a result of which the injection valve 20 opens and enables a fuel flow to the injection nozzle 22. There, the fuel is injected into the combustion chamber 23. After a predetermined injection duration has elapsed, which correlates with a fuel quantity intended for the particular operating range of the engine, the control valve 19 is closed again, so that a closing pressure can build up at the injection valve 20, the consequences of which are that the injection valve 20 is closed again and the fuel delivery line 9 is blocked. The injection event is then ended. As long as the fuel quantity flowing through the flow limiting valve 24 or out of the flow limiting valve 24 during the injection event is less than the maximum fuel quantity defined in the flow limiting valve 24, the fuel delivery line 9 remains open.

The mode of operation of the flow limiting valve 24 will now be explained in conjunction with FIG. 3, in which one such flow limiting valve 24 is shown in longitudinal section. It is clear that in the present invention, this special embodiment of the flow limiting valve 24 is not critical, so that in the fuel injection system of the invention any flow limiting valve that functions suitably but is fundamentally arbitrary in construction can be used.

Figure 3:
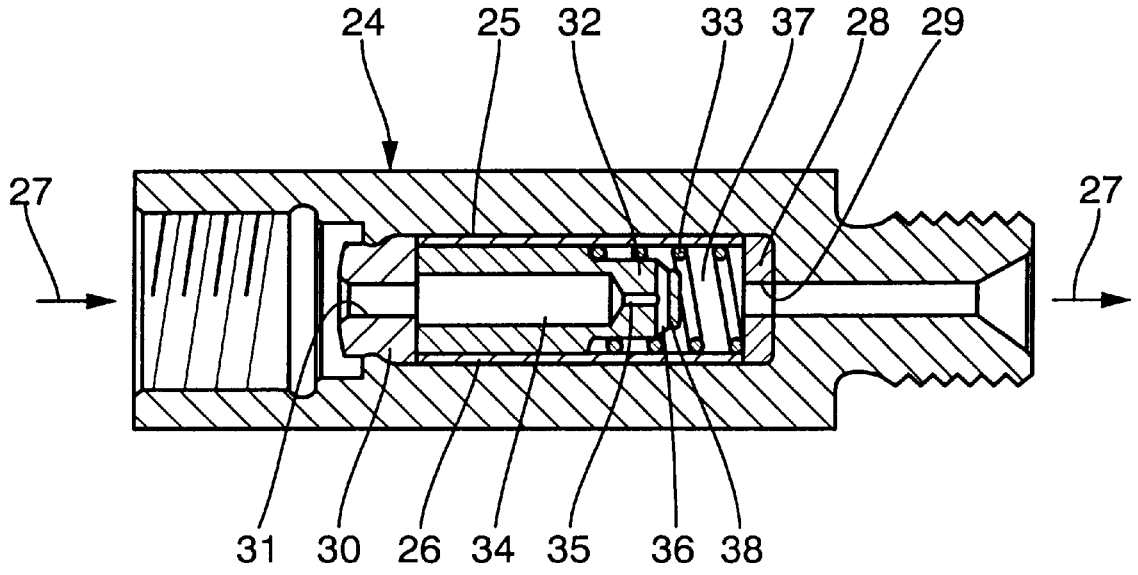
FIG. 3 is a schematic longitudinal section through a flow limiting valve.

In FIG. 3, the flow limiting valve 24 includes a cylinder chamber 25, into which a sliding sleeve 26 is inserted. The sliding sleeve 26 is axially limited downstream (the direction of flow through the flow limiting valve 24 is represented by arrows 27) by an axial body 28 with a coaxial outflow opening 29 and upstream by an axial body 30 with a coaxial inflow opening 31. A sleeve-like piston 32 is axially adjustably supported in the sliding sleeve 26. The piston 32 is prestressed against the upstream axial body 30 by a helical compression spring 33, which is supported on the downstream axial body 28 and on the piston 32, on the inflow side, the piston 32 includes an axial opening 34, which communicates via a throttle restriction 36 with a radial opening 36 on the outflow side. A pumping chamber 37 is embodied between the piston 32 and the axial body 28 on the outflow side.

Mode of Operation of the Flow Limiting Valve 24:

As soon as a pressure difference occurs between the inflow side and the outflow side, this difference acts on the piston 32. Also acting on the piston 32 is the spring force of the spring 33, and—in the case of a flow through the piston 32—the throttle resistance in the throttle 35. If there is a great enough pressure difference between the inlet side and outlet side of the flow limiting valve 24, the piston 32 is accordingly adjusted downstream, and essentially the fuel contained in the pumping chamber 37 can flow out of the flow limiting valve 24 through the outflow opening 29. If the aforementioned pressure difference lasts long enough, the piston 32 finally comes to contact an end plate 38, embodied downstream at the piston 32 on the outflow-side axial body 28, thereby tightly closing the outflow opening 29. The end plate 38 and the downstream axial body 28 are embodied to suit the development of this sealing action. By means of the pumping chamber 37, it is thus possible to define a maximum fuel quantity, which is the fuel quantity that can maximally flow through the flow limiting valve 24 or out of it during one injection event.

As soon as there is no longer any pressure gradient between the inflow side and the outflow side of the flow limiting valve 24, the end plate 38 can lift from the downstream axial body; the pumping chamber 37, increasing in size as a result of the restoring motion of the piston 32, thus fills with fuel via the throttle 35. The throttle 35 is dimensioned such that even at maximum engine rpm, it is certain that the pumping chamber 37 can become completely filled.

Since the maximum fuel quantity is designed for maximum engine power, leaks in the fuel delivery line downstream of the flow limiting valve 24 cause contact of the end plate 38 with the downstream axial body 28, and thus blockage of the fuel delivery line, only whenever the engine is being operated in the range of its maximum power, or whenever the leak is so great that it causes a downstream-oriented adjustment of the piston 32 or prevents an upstream-oriented restoring motion of the piston 32.

To allow the applicable cylinder 7 to be decoupled from the fuel delivery line 9 even in the event of smaller leaks, the invention functions as follows:

As soon as the control unit 1, in the evaluation of the pressure signals of the pressure sensors 14 and/or the knocking signals of the knocking sensors 16, ascertains that too much fuel is being combusted in one of the cylinders 7, the control unit 1 assumes that a leak has occurred in the associated injection unit 6. For the next injection event that is to take place at the applicable cylinder 7, the control unit 1 selects an increased injection duration, and via the associated switch line 18 the control unit actuates the corresponding control valve 19 for an excessively long time accordingly. By coupling the injection valve 20 to the control valve 19, the injection valve 20 also remains open for an excessively long time, so that—if there were no flow limiting valve 24 in the fuel delivery line 9—it would be certain that more than the maximum fuel quantity would be injected into the combustion chamber 23 via the nozzle 22. However, since the flow limiting valve 24 is indeed present, it blocks the fuel delivery line 9 as soon as the maximum fuel quantity has flowed out. The resultant combustion with an excess fuel quantity in the affected cylinder 7 presents no risk to the engine, especially because the fuel quantity is limited to the maximum fuel quantity.

The additional injection quantity, or the entire injection quantity, can preferably be introduced into the cylinder 7 at an instant when ignition is no longer occurring, or a great pressure can no longer build up in the cylinder 7. Accordingly, the injection can take place toward bottom dead center of the piston, if normally the combustion is ended and the outlet and inlet valves are opened.

Even though the control valve 19 and the injection valve 20 are closed again after this artificially lengthened injection event, the leak in the fuel delivery line 9 downstream of the flow limiting valve 24 previously detected by the sensors 14, 16 has the effect that a pressure gradient continues to exist between the inflow side and the outflow side of the flow limiting valve 24, and thus the flow limiting valve 24 can no longer open the fuel delivery line 9 to the affected cylinder 7.

By means of the fuel injection system of the invention, the flow limiting valves 24 can thus be used to shut off individual cylinders 7, even if only relatively small leaks occur and the engine is not being operated in the low operating range that requires a maximum fuel quantity.

The foregoing relates to a preferred exemplary embodiment of the invention, it being understood that other variants and embodiments thereof are possible within the spirit and scope of the invention, the latter being defined by the appended claims.

I claim:

1. A fuel injection system for an internal combustion engine having a plurality of cylinders (7), comprising a plurality of injection units (6), each of said injection unit are assigned to one cylinder (7) and each have one injection valve (20), one control valve (19), one flow limiting valve (24), and one injection nozzle (22) and are each supplied with fuel via a fuel delivery line (9), a control unit, which for an injection of a predetermined fuel quantity into a combustion chamber (23) of one of the cylinders (7), the control unit actuates the corresponding control valve (19), for instance electrically, for an injection duration that is correlated with a predetermined fuel quantity, and the actuated control valve (19) actuates the associated injection valve (20), and the actuated injection valve (20) opens the fuel delivery line (9) upstream of the injection nozzle (22) so that fuel is injected into the combustion chamber (23), and the flow limiting valve (24), disposed upstream of the injection valve (20) and the fuel delivery line (9), blocks the fuel delivery line (9) when the fuel quantity flowing through or out of the flow limiting valve (24) attains a maximum fuel quantity, and said flow limiting valve (24) does not reopen until the fuel delivery line (9) downstream of the flow limiting valve (24) is blocked, each injection unit (6) is assigned at least one sensor (14, 16), with which a leak in the fuel delivery line (9) downstream of the flow limiting valve (24) is ascertained and which sends a leakage signal signalling said leak to the control unit (1), the control unit (1) disconnects the cylinder for whose associated injection unit (6) such a leakage signal is present from the fuel delivery line (9), in that the control unit (1) increases the injection duration for that cylinder (9) sufficiently that the thus-correlated fuel quantity is greater than the maximum fuel quantity.

2. The fuel injection system in accordance with claim 1, in which the sensor is embodied as a knocking sensor (16), which monitors a noise development in the respective cylinder (7).

3. The fuel injection system in accordance with claim 1, in which the sensor is embodied as a pressure sensor (14), which monitors the pressure prevailing in a respective cylinder (7).

4. The fuel injection system in accordance with claim 2, in which the sensor is embodied as a pressure sensor (14), which monitors the pressure prevailing in a respective cylinder (7).

5. The fuel injection system in accordance with claim 1, in which the control unit (1), for disconnecting one of the cylinders (7) from the associated fuel delivery line (9), increases the injection duration by a maximum of up to three times a maximum injection duration provided for normal engine operation of that cylinder.

6. The fuel injection system in accordance with claim 2, in which the control unit (1), for disconnecting one of the cylinders (7) from the associated fuel delivery line (9), increases the injection duration by a maximum of up to three times a maximum injection duration provided for normal engine operation of that cylinder.

7. The fuel injection system in accordance with claim 3, in which the control unit (1), for disconnecting one of the cylinders (7) from the associated fuel delivery line (9), increases the injection duration by a maximum of up to three times a maximum injection duration provided for normal engine operation of that cylinder.

8. The fuel injection system in accordance with claim 1, in which the control unit (1), for disconnecting one of the cylinders (7) from the associated fuel delivery line (9), increases the injection duration by a maximum of up to 300° of crankshaft angle.

9. The fuel injection system in accordance with claim 2, in which the control unit (1), for disconnecting one of the cylinders (7) from the associated fuel delivery line (9), increases the injection duration by a maximum of up to 300° of crankshaft angle.

10. The fuel injection system in accordance with claim 3, in which the control unit (1), for disconnecting one of the cylinders (7) from the associated fuel delivery line (9), increases the injection duration by a maximum of up to 300° of crankshaft angle.

11. The fuel injection system in accordance with claim 4, in which the control unit (1), for disconnecting one of the cylinders (7) from the associated fuel delivery line (9), increases the injection duration by a maximum of up to 300° of crankshaft angle.

12. The fuel injection system in accordance with claim 5, in which the control unit (1), for disconnecting one of the cylinders (7) from the associated fuel delivery line (9), increases the injection duration by a maximum of up to 300° of crankshaft angle.

13. The fuel injection system in accordance with claim 6, in which the control unit (1), for disconnecting one of the cylinders (7) from the associated fuel delivery line (9), increases the injection duration by a maximum of up to 300° of crankshaft angle.

14. The fuel injection system in accordance with claim 7, in which the control unit (1), for disconnecting one of the cylinders (7) from the associated fuel delivery line (9), increases the injection duration by a maximum of up to 300° of crankshaft angle.

15. The fuel injection system in accordance with claim 1, in which the control unit (1), for disconnecting one of the cylinders (7) from the associated fuel delivery line (9), increases the injection duration to 105° of crankshaft angle.

16. The fuel injection system in accordance with claim 2, in which the control unit (1), for disconnecting one of the cylinders (7) from the associated fuel delivery line (9), increases the injection duration to 105° of crankshaft angle.

17. The fuel injection system in accordance with claim 3, in which the control unit (1), for disconnecting one of the cylinders (7) from the associated fuel delivery line (9), increases the injection duration to 105° of crankshaft angle.

18. The fuel injection system in accordance with claim 5, in which the control unit (1), for disconnecting one of the cylinders (7) from the associated fuel delivery line (9), increases the injection duration to 105° of crankshaft angle.

19. The fuel injection system in accordance with claim 8, in which the control unit (1), for disconnecting one of the cylinders (7) from the associated fuel delivery line (9), increases the injection duration to 105° of crankshaft angle.

20. The fuel injection system in accordance with claim 9, in which the control unit (1), for disconnecting one of the cylinders (7) from the associated fuel delivery line (9), increases the injection duration to 105° of crankshaft angle.

* * * * *